United States Patent [19]

Lazure et al.

[11] 4,054,207

[45] Oct. 18, 1977

[54] PACKAGE CONSTRUCTION

[75] Inventors: Frank S. Lazure; William C. Whitaker, both of Richmond, Va.

[73] Assignee: Reynolds Metals Company, Richmond, Va.

[21] Appl. No.: 684,482

[22] Filed: May 10, 1976

[51] Int. Cl.[2] ..... B65D 85/62; B65D 21/04; B65D 1/24

[52] U.S. Cl. ..... 206/486; 206/45.33; 206/518; 206/526; 220/23.4; 229/2.5 R

[58] Field of Search ..... 206/526, 486, 532, 461, 206/45.33, 563, 562; 229/2.5, 15; 220/74, 23.4

[56] References Cited

U.S. PATENT DOCUMENTS

| | | | |
|---|---|---|---|
| 3,203,583 | 8/1965 | Amberg et al. | 229/2.5 |
| 3,351,192 | 11/1967 | La Plante | 206/532 |
| 3,390,766 | 7/1968 | Stockdale | 206/486 |
| 3,502,241 | 3/1970 | Smith | 229/2.5 |
| 3,850,340 | 11/1974 | Siemonsen et al. | 220/74 |

FOREIGN PATENT DOCUMENTS

| | | | |
|---|---|---|---|
| 1,112,426 | 5/1968 | United Kingdom | 206/486 |

*Primary Examiner*—William T. Dixson, Jr.
*Attorney, Agent, or Firm*—Glenn, Lyne, Gibbs & Clark

[57] ABSTRACT

A plurality of disposable sealed containers having top annular flanges are supported by their flanges in spaced relation in a protective tray.

16 Claims, 10 Drawing Figures

PACKAGE CONSTRUCTION

BACKGROUND OF THE INVENTION

In marketing sealed disposable containers having unit doses of medicine, individual servings of foods such as desserts, and the like, in packages containing a plurality of such containers, it is a problem to provide such packages at minimum cost yet assure that the disposable containers are protected in an optimum manner during storage, handling, display for sale, and dispensing thereof.

SUMMARY

This invention provides an improved package construction which basically overcomes the above-mentioned problem and such package construction comprises a tray and a plurality of containers carried within the tray with each of the containers comprising a side wall, an annular flange extending outwardly from the side wall, and a closure sealed against the annular flange and having at least a portion thereof extending outwardly of the flange; and, the tray has at least one elongate open-top chamber defined by a bottom wall adjoined by an upwardly extending tubular wall, a set of flange supports adjoining the tubular wall and supporting the flanges and containers thereon, and a set of closure supports adjoining associated ones of the flange supports and receiving the outwardly extending portions of the closures therewithin.

Other details, uses, and advantages of the invention will become apparent as the following description of the embodiment thereof presented in the accompanying drawings proceeds.

BRIEF DESCRIPTION OF THE DRAWINGS

The accompanying drawings show a present preferred embodiment of the invention, in which.

DESCRIPTION OF ILLUSTRATED EMBODIMENT

Figure 1:
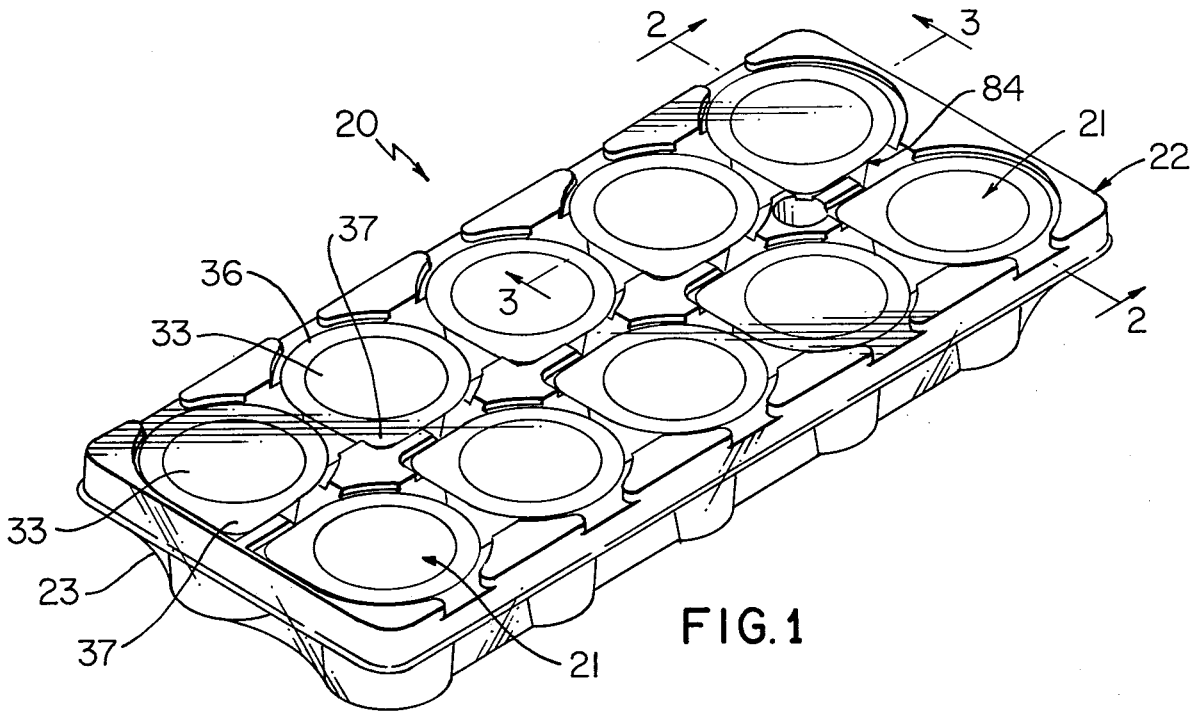
FIG. 1 is a perspective view of one exemplary embodiment of the package construction of this invention comprised of a protective tray which has a plurality of disposable sealed containers disposed therein with a film of transparent plastic surrounding the tray and containers.

Reference is now made to FIG. 1 of the drawings which illustrates one exemplary embodiment of the package construction of this invention which is designated generally by the reference numeral 20 and such package construction is comprised of a plurality of disposable containers 21 carried within a single-piece tray 22 with a film 23 of transparent thermoplastic material heat-shrunk around the package construction 20, which will also be referred to as package 20, to hold the containers 21 within the tray 22. Each container is preferably of the type disclosed in U.S. Pat. No. 3,850,340, and may range in volume from a fraction of an ounce to six ounces or more whereby each container depending upon its volume, may be used to contain a unit dose of medicine, a food product such as a dessert, or other suitable product.

Figure 2:
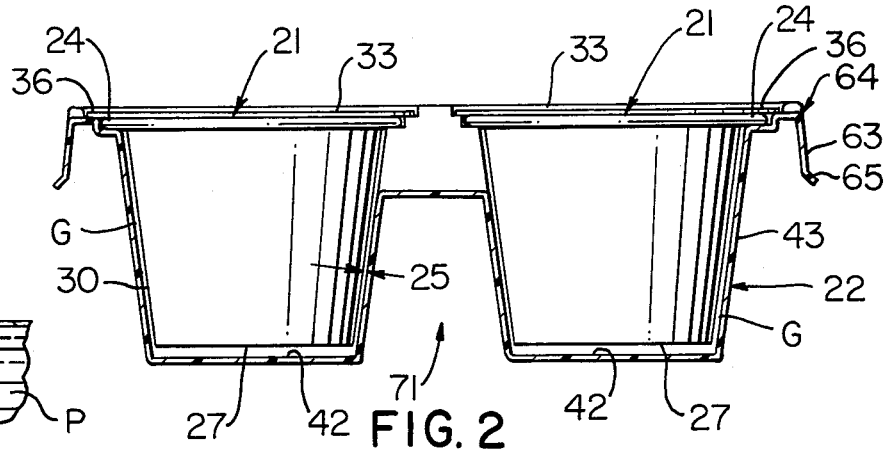
FIG. 2 is a cross-sectional view taken essentially on the line 2—2 of FIG. 1.

As seen in FIG. 2, for example, the containers 21 are supported in the tray 22 by their annular flanges 24, which will be described in more detail subsequently, and each flange 24 basically provides the sole support for its container 21 by supporting its weight as well as the top portion thereof against horizontal movements. The construction of each container 21 and the tray 22 is such that a protective isolating gap G is provided around each container 21; and, if desired such gap may also be provided between the bottom of each container 21 and the tray 22 are shown herein. The gap G varys in thickness from a thickness 25 adjacent the sides of the tray 22 to a thickness 26 between immediately adjacent containers.

Each of the containers 21 comprises a bottom wall 27 adjoined by a frustoconical side wall 30 and the flange 24 extends radially outwardly from the top edge portion 31 (see FIG. 2A) of its frustoconical side wall 30 and terminates in a toroidal bead 32 which may be in the form of a reverse toroidal bead. Each container 21 has is product P sealed therewithin by a sheet-like closure 33 made of aluminum-containing metallic foil and the closure 33 is sealed against a top planar annular surface 34 of flange 24 by adhesive means 35 in the form of a thermoplastic adhesive layer 35.

Figure 2A:
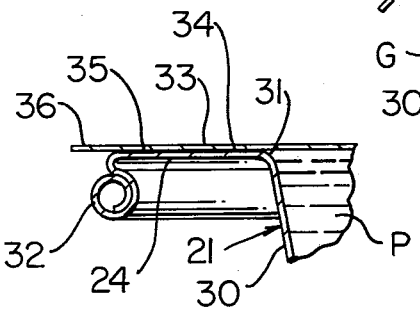
FIG. 2A is an enlarged fragmentary cross-sectional view of an upper portion of a typical sealed container of FIG. 1.

As best seen in FIGS. 1, 2, and 2A, the closure 33 has an annular portion 36 extending radially outwardly of the flange 24 and in particular the bead 32 of such flange; and, the annular portion 36 has an easily grasped roughly triangular enlarged portion 37 extending outwardly beyond the annular portion 36. Each portion 37 is used to remove its closure 33 from as associated container 21; and, in the package construction 20 each portion 37 is used to assure its container is oriented or aligned in the tray 22 in the desired manner.

Figure 4:
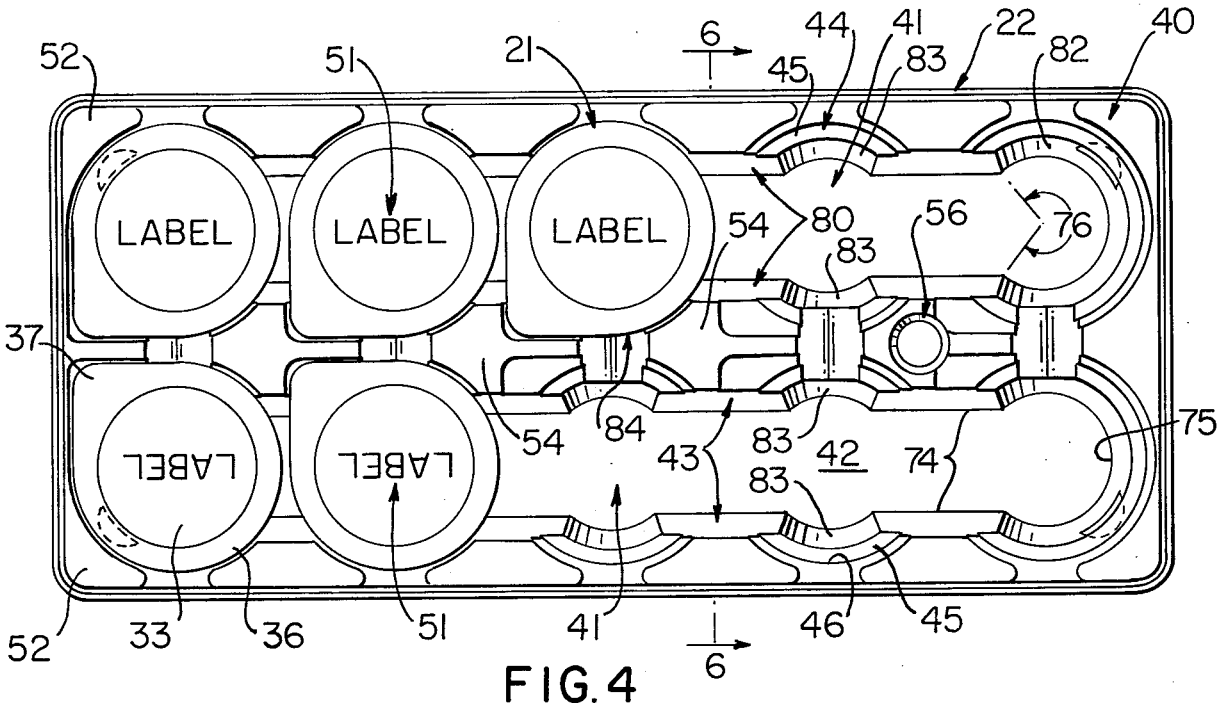
FIG. 4 is a top plan view of the package construction of FIG. 1 with the transparent film and five containers removed.
Figure 5:
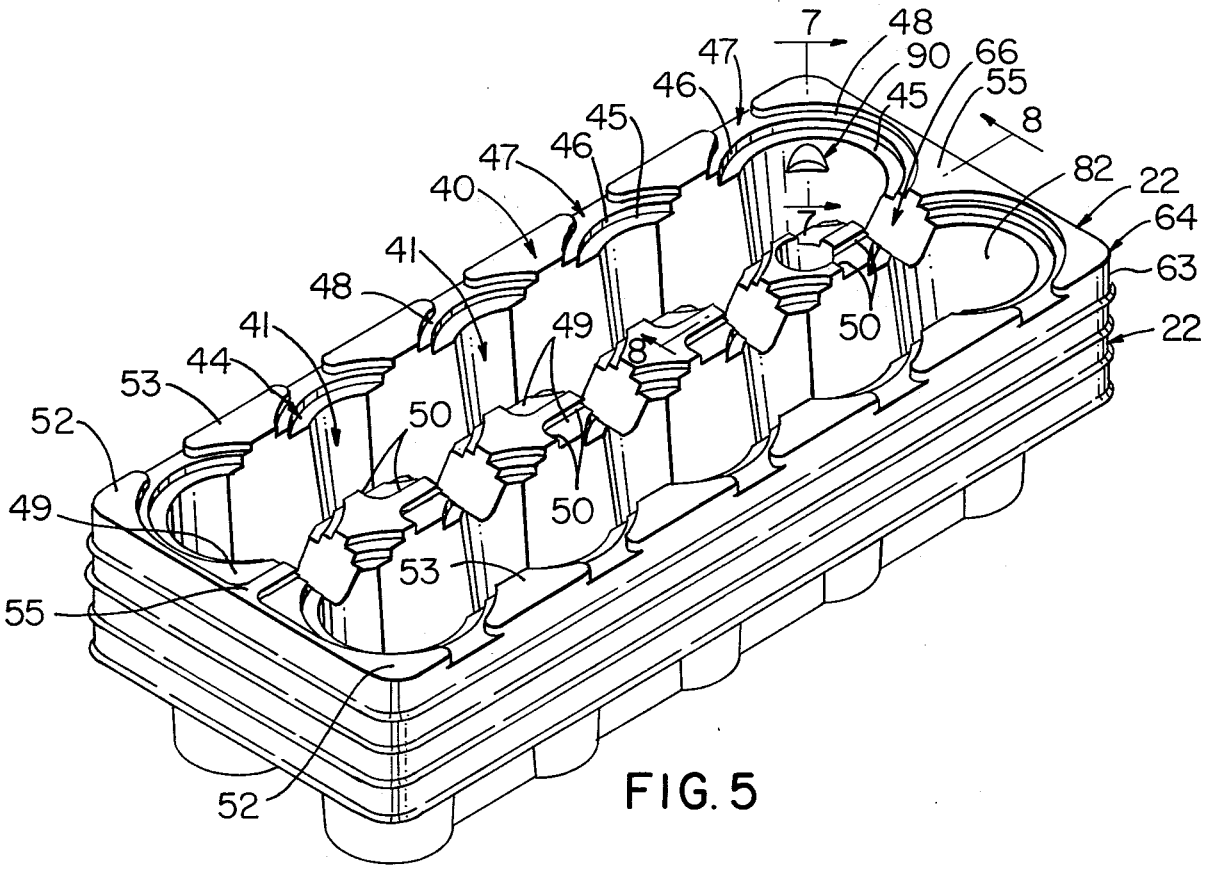
FIG. 5 is a perspective view illustrating a plurality of four trays, which are identical to the tray of the package construction of FIG. 1, stacked in nested relation.
Figure 6:
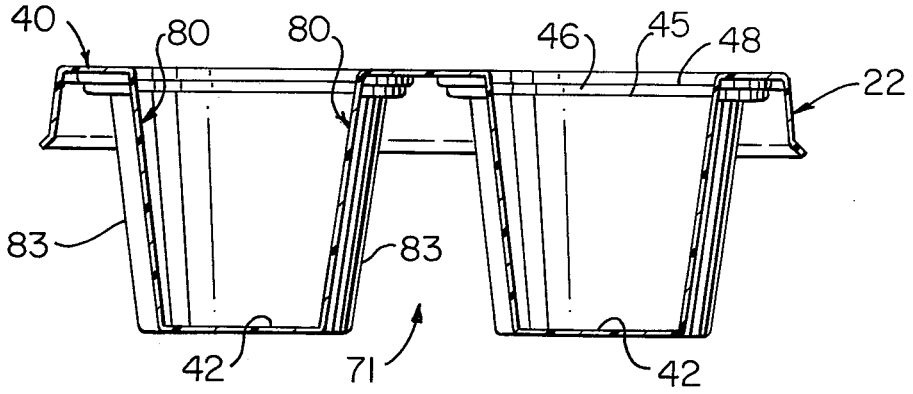
FIG. 6 is a cross-sectional view taken essentially on the line 6—6 of FIG. 4.

The tray 21 has a top wall 40, see FIGS. 4 and 5, and a plurality, two in this example, of integral open-top chambers 41 defined as an integral part thereof and disposed beneath the top wall 40. Each chamber 41 is defined by a planar bottom wall 42 adjoined by an upwardly extending tubular wall 43.

The tray 21 has a set of flange supports comprised of a plurality of flange supports each designated generally by the reference numeral 44. The flange supports 44 adjoin the tubular wall 43 and support the flanges 24 and in particular the toroidal beads 32 of such flanges 24 and the containers 21 thereon. The supports 44 have horizontal ledge portions 45 which support the weights of associated containers and vertical wall portions 46 which support the top portions of the containers 21 against horizontal movements.

The tray 22 also has a set of closure supports comprised of a plurality of closure supports each designated generally by the reference numeral 47. The closure supports 47 adjoin associated flange supports 44 and such closure supports receive the outwardly extending portions of the closures 33 thereon; and, each closure support 47 comprises an annular ledge portion 48 adjoining the upwardly extending portion 46 of each flange support 44 and a ledge portion 49 of substantial area which in this example is substantially triangular. Each ledge portion 48 supports the annular portion 36 of an associated closure 33 while each ledge portion 49 supports the roughly triangular portion 37 of such closure. Each roughly triangular ledge portion 49 is adjoined by upwardly extending vertical wall portions 50 which are engaged by the edges of an associated triangular portion 37 and serve to align the associated container within the tray 22 so that the labeling thereof may be read from either side of the package construction. For convenience such labeling is designated by the word LABEL, as shown at 51, on each closure 33 of each container 21 shown in FIG. 4.

In addition to its integral supports 44 and 47 the top wall 40 is also comprised of a plurality of spaced top portions of various configurations (see FIGS. 4 and 5) including corner portions 52, side portions 53, and what may be considered arrowhead-shaped central portions 54. The two corner portions 52 at each end of tray 22 are interconnected by a roughly T-shaped ridge portion 55; and, the T-shaped portion 55 at one end of tray 22 is slightly different in its detailed configuration than the corresponding portion 55 at the opposite end.

Thus, it is seen that the top wall 40 of each tray 22 is comprised of supports 44 and 47 with their component portions as described previously; portions 52, 53, 54, and 55; and rigidifying V-shaped structures, which will be described subsequently. The portions 52–55 have top surfaces which are coplanar and are engaged by the transparent plastic film 23.

Figure 8:
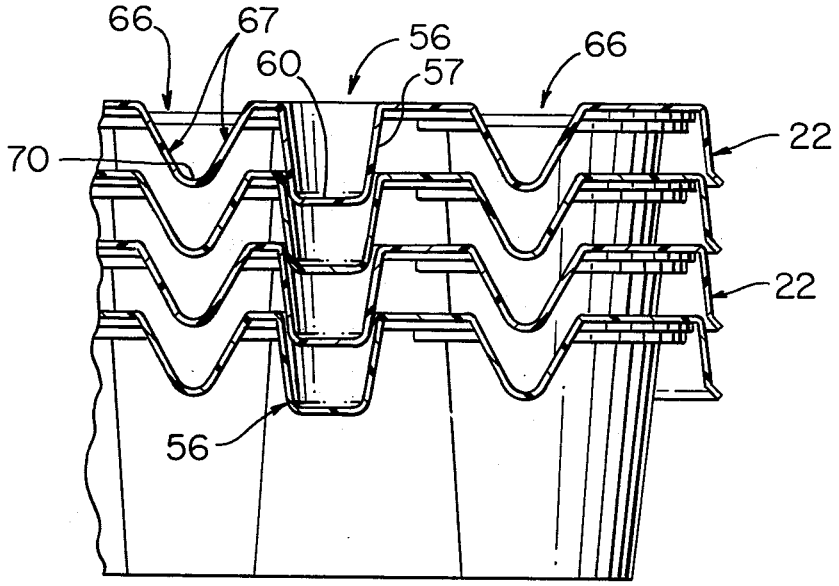
FIG. 8 is a fragmentary cross-sectional view taken essentially on the line 8—8 of FIG. 5 and particularly illustrating integral cup-shaped structures of the trays which are used to assure such trays are all oriented or arranged in the same direction during stacking.

Each tray 22 has integral means in the form of cup-like structure 56, see FIG. 8, which assures that a plurality of trays 22 may be stacked with the same orientation, i.e., so that a particular end of each tray 22 is always disposed at the same relative position in a stack thereof whereby a stack of trays 22 may be processed automatically by associated tray handling apparatus. The cup-like structure 56 is provided adjacent one end of the tray 22 and in this example extends downwardly through a central top wall portion 54 disposed closely adjacent one end of the tray. The structure 56 has a frustoconical side wall 57 and a planar bottom wall 60 with the frustoconical side wall allowing stacking of trays in nested relation. It will be appreciated that if a top tray 22, for example, of a stack of trays is rotated 180° so that its cup-like structure 56 is not nested within the cup-like structure 56 of the supported tray therebeneath the bottom wall 60 of the structure 56 of such rotated tray will engaged a portion of the top wall 40 of its supporting tray preventing the nesting of the rotated tray thereby enabling easy determination that the tray is not properly aligned. It will be appreciated that with the trays 22 aligned and nested in their stacks, tray handling apparatus and container handling apparatus may cooperate to fill each tray 22 with filled containers 21 having labeling as shown at 51 and for the purpose previously described.

Each tray 22 has a depending skirt 63 extending downwardly from a top edge 64 of its top wall 40 and the skirt has an outwardly flared bottom portion 65 (see FIGS. 2 and 5). The tray 22 also has a plurality of spaced V-shaped structures as previously mentioned and each of such structures is designated generally by the reference numeral 66, see FIG. 8. The V-shaped structures 66 and the depending skirt 63 with its flared bottom portion 65 serve to improve the structural rigidity of the tray 22.

Each V-shaped structure 66 is defined as an integral part of the top wall 40 and is comprised of a pair of cooperating planar portions 67 arranged in a V-shaped pattern and terminating in curved elongated channel 70 which is disposed horizontally perpendicular to the longitudinal axis of the tray 22. The spaced channels 70 are disposed equal distances beneath a plane coinciding with the top surfaces of the portions 52–55 of the top wall 40. The opposed end edges of each V-shaped structure 66 adjoin and coincide smoothly with the closely adjacent sides of the tubular walls 43 of the pair of chambers 41 and prevent the tubular walls 43 from being pushed or collapsed toward each other. For example, the V-shaped structures 66 cooperate with the depending skirt 64 and its flared portion 65 to assure that each tray may not be collapsed about a central longitudinal axis therethrough by urging the bottom portions of the tubular walls 43 toward each other due to the substantial space 71 (see FIG. 2) provided between such tubular walls.

As best seen in FIGS. 4 and 5, the bottom wall 42 of each chamber 41 has a generally oblong configuration defined by elongate opposed side edges each designated by the same reference numeral 74 and opposed curved end edges each designated by the reference numeral 75. The curved end edges extend through a circular arc of approximately 270° as indicated at 76.

The tubular wall 43 is a continuous enclosing wall defined by opposed side wall portions or side walls each designated by the same reference numeral 80 and each adjoining an associated elongated side edge 74 at the base thereof and each tubular wall 43 has opposed curved end wall portions or end walls 82 which are substantially semifrustoconical and each adjoins an associated curved end edge 75 of the bottom wall 42. The curved end wall portions 82 interconnect opposed ends of the side wall portions 80; and, each of the curved end wall portions 82 has an associated container 21 disposed therein.

To assure nestability of trays 22, each tubular enclosing wall 43 comprising an elongate chamber 41 of each tray 22 has upwardly diverging side walls 80. The side walls 80 have cooperating pairs of inwardly concave side wall portions 83. Each of the inwardly concave portions 83 of a cooperating pair thereof is disposed in the tray 22 at the same relative position from an end of the tray.

Each of the substantially roughly semifrustonconical end walls 82 has an associated container 21 disposed therewithin; and each cooperating pair of side wall portions 83 has an associated container 21 disposed therewithin. Each end wall 82 and inwardly concave side wall portion 83 is disposed relative to its container 21 so that there is a gap G of a thickness 25 therebetween. The gap G of thickness 25 serves to isolate its container 21 and protect it against direct impact; however, the thickness 25 of such gap G is sufficiently small that a package 20 filled with a plurality of containers 21 may be turned or rested on its end, i.e. on its smaller dimension, and the wall portions 82 and 83 serve to confine or restrain the bottom portions of the containers 21 from moving together. The top portions of the containers are supported by flange supports 44.

As mentioned above, the tray 22 has V-shaped structures 66 which serve to increase the rigidity of such tray transverse its longitudinal dimension or axis. However, it will be seen that each of such structures inherently also defines a comparatively large size V-shaped groove in the top wall 40; and, such a groove facilitates inserting an object such as a finger therein, as shown at 84 in FIG. 1, to enable containers 21 thereabove to be engaged under their flanges 24 and lifted from the tray 22.

Figure 7:
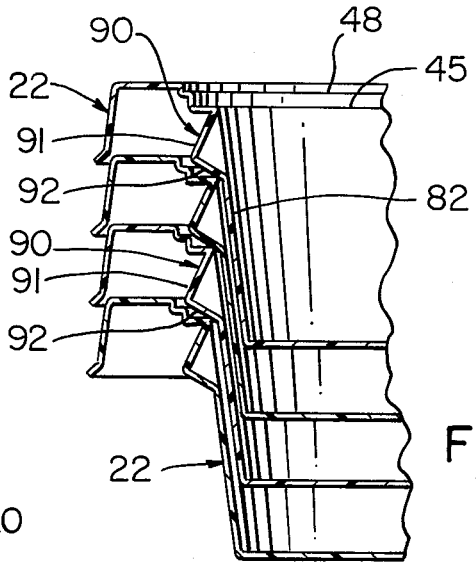
FIG. 7 is a fragmentary cross-sectional view taken essentially on the line 7—7 of FIG. 5 particularly illustrating corner lugs of the trays which are used to prevent such trays from wedging together during the stacking.

As best seen in FIGS. 5 and 7, each tray 22 has integral stacking lugs 90 in its four corners defined by portions of each curved wall 82 which are formed outwardly to define an associated recess in the inside of the tray 22 and a corresponding projection 91 on the outside of such tray. Each projection 91 has a substantially horizontally disposed surface 92 which engages a tray therebeneath whereby a plurality of stacked trays 22 are prevented from being wedged together during stacking to facilitate handling by automatic packaging apparatus.

The tray 22 may be made of any suitable material such as metal foil, paper, or synthetic plastic, for example. Preferably such tray is made of a suitable elastomeric thermoplastic or thermosetting material by thermoforming or similar process.

Figure 3:
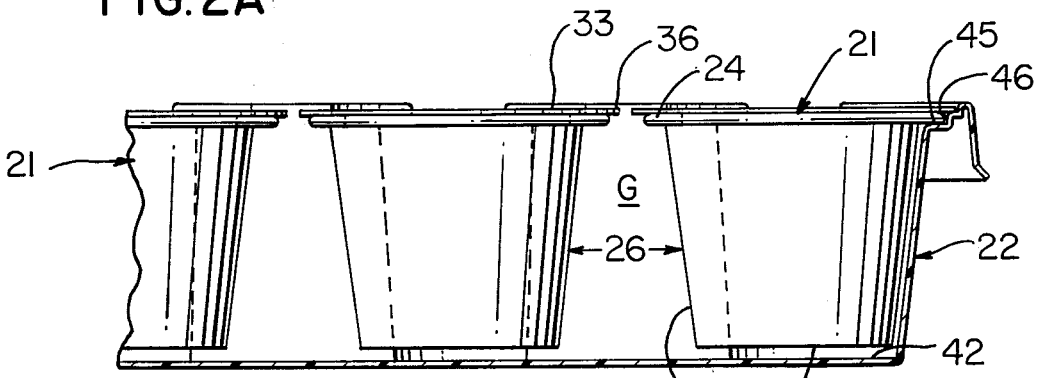
FIG. 3 is a fragmentary cross-sectional view taken essentially on the line 3—3 of FIG. 2.

As previously mentioned the containers 21 of each package construction 20 are supported in their tray 22 by their annular flanges 24 and in particular by the integral toroidal beads 32 defining the peripheral portions of such flanges 24, see FIGS. 2, 2A, and 3. Each bead portion 32 of each flange basically provides the sole support for its container 21 by supporting the container weight on a horizontal ledge portion 45 of a flange support 44 as well as supporting the top portion of its container 21 against horizontal movements due to engagement of the bead portion 32 against an adjoining vertical wall portion 46 of such flange supports 44.

Figure 9:
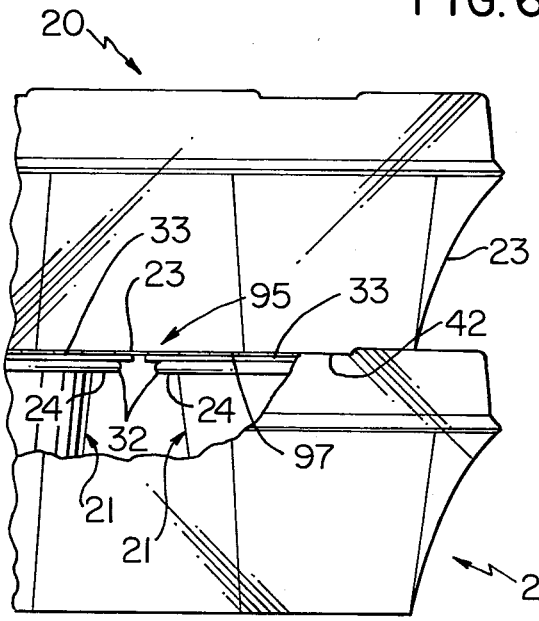
FIG. 9 is a fragmentary side view of one end portion of a plurality of two package constructions of this invention disposed in stacked relation with certain parts shown in elevation and other parts in cross-section.

The package construction 20 of this invention lends itself to stacking with minimum likelihood of damage to its containers. Referring now to FIG. 9, it will be seen that the major part of the weight of one or more package constructions 20 stacked on a lower package construction is carried by the flanges 24 and their integral annular beads 32 of the containers 21 of the lower package construction as shown at 95 due to the bottom surfaces 97 of the planar bottom walls 42 being, in essence, supported by such flanges 24 and beads 32 acting through the interposed plastic film 23. The film 23 may provide some support at locations remote from the flanges 24. Nevertheless, it will be seen that with the package construction of this invention there is minimum likelihood that the closures 33 of containers 21 of a lower supporting package construction 20 will be ruptured by the weight of one or more package constructions 20 supported thereon.

While present exemplary embodiments of this invention, and methods of practicing the same, have been illustrated and described, it will be recognized that this invention may be otherwise variously embodied and practiced within the scope of the following claims.

What is claimed is:

1. A package construction comprising a tray having coplanar top surface portions and a plurality of containers carried within said tray; each of said containers comprising a side wall, an annular flange extending outwardly from said side wall, and a closure sealed against said annular flange and having at least a portion thereof extending outwardly of said flange; said tray having at least one elongate open-top chamber defined by a bottom wall adjoined by an upwardly extending tubular wall, a set of flange supports adjoining said tubular wall and supporting said flanges and containers thereon, and a set of closure supports, adjoining associated ones of said flange supports, said closure supports being disposed beneath said coplanar top surface portions, said closure supports receiving said outwardly extending portions of said closures therewithin beneath said coplanar top surface portions.

2. A package construction as set forth in claim 1 in which said bottom wall has a generally oblong configuration defined by elongate opposed side edges and opposed curved end edges, said tubular wall is defined by opposed side walls each adjoining an associated elongate side edge and opposed curved end walls each adjoining an associated curved end edge and interconnecting associated ends of said opposed side walls, and each of said curved end walls has an associated container disposed therewithin.

3. A package construction as set forth in claim 2 in which said opposed side walls have cooperating pairs of inwardly concave side wall portions with each cooperating pair having an associated container disposed therewithin.

4. A package construction as set forth in claim 3 in which each of said curved end walls and inwardly concave side wall portion is spaced from an associated container to provide a protective gap therebetween yet is sufficiently close to restrain the bottom portion of the associated container.

5. A package construction as set forth in claim 3 in which the side wall of each of said containers is substantially frustoconical and each of said curved end walls is approximately semifrustoconical.

6. A package construction as set forth in claim 3 in which said annular flange of each of said containers has a substantially toroidal bead defining the outer end portion thereof, said bead supporting its container on an associated flange support.

7. A package construction as set forth in claim 6 in which, said closure of each of said containers is a substantially sheet-like closure said portion of said closure extending outwardly from said flange includes an annular portion extending radially outwardly of said toroidal bead and a substantially triangular portion extending outwardly of said annular portion, and each closure support of said set of closure supports includes a ledge portion supporting an associated annular portion and a ledge portion of substantially triangular area supporting an associated triangular portion of said closure.

8. A package construction as set forth in claim 3 in which said tray is a single-piece tray made of a synthetic plastic material and has a substantially uniform thickness throughout all of its component portions.

9. A package construction as set forth in claim 3 and further comprising means confining said containers within said tray beneath said coplanar top surface portions.

10. A package construction as set forth in claim 9 in which said confining means comprises a sheet of transparent plastic film.

11. A package construction as set forth in claim 3 in which each of said trays has a plurality of lugs extending from its corners which enable a plurality of empty trays to be stacked in nested relation in a nonwedging manner.

12. A package construction as set forth in claim 11 in which each tray has integral means in the form of a cup-like structure adjacent one end thereof which assures that said plurality of empty trays may be stacked with the same orientation.

13. A package construction comprising a single-piece tray and a plurality of containers carried within said tray; each of said containers comprising, a side wall having a top edge portion, an annular flange extending outwardly from said top edge portion and terminating in a peripheral toroidal bead, and a closure sealed against said bead and having at least a portion thereof extending outwardly of said flange; said tray having a top wall and a plurality of open top chambers disposed beneath said top wall and each of said chambers being defined by a bottom wall adjoined by an outwardly extending tubular wall, said top wall comprising, a set of flange supports adjoining an associated tubular wall and supporting said flanges of associated containers thereon, a set of closure supports adjoining associated ones of said flange supports, a plurality of coplanar top surface portions adjoining said closure supports, said closure supports receiving said outwardly extending portions of said closures therewithin beneath said coplanar top surface portions, and a plurality of roughly V-shaped structures each having opposed end edges which adjoin and coincide smoothly with the closely adjacent sides of adjacent tubular walls of adjacent open top chambers.

14. A package construction as set forth in claim 13 in which said top wall has a depending skirt extending about its entire periphery, said depending skirt cooperating with said V-shaped structures to assure said tray maintains rigidity about a central longitudinal axis therethrough upon urging the bottom portions of the tubular walls toward each other.

15. A package construction as set forth in claim 14 in which each of said containers is supported by its annular flange so that a bottom surface thereof is disposed in spaced relation above the bottom wall of its compartment.

16. A package construction as set forth in claim 13 in which said top wall is comprised of a plurality of spaced top portions including corner portions, side portions, and central portions, one of said central portions being disposed closely adjacent one end of said tray and having a cup-shaped structure extending from its top surface which assures a plurality of empty trays may be stacked with the same orientation.

* * * * *